US010011047B1

(12) United States Patent
Higgins

(10) Patent No.: US 10,011,047 B1
(45) Date of Patent: Jul. 3, 2018

(54) MASONRY VENEER MACHINE

(71) Applicant: Joshua Higgins, Orange, CA (US)

(72) Inventor: Joshua Higgins, Orange, CA (US)

( * ) Notice: Subject to any disclaimer, the term of this patent is extended or adjusted under 35 U.S.C. 154(b) by 399 days.

(21) Appl. No.: 14/834,090

(22) Filed: Aug. 24, 2015

Related U.S. Application Data

(63) Continuation of application No. 14/151,740, filed on Jan. 9, 2014, now Pat. No. 9,138,914.

(51) Int. Cl.
*B28D 1/04* (2006.01)
*B28D 7/04* (2006.01)
*B24B 49/00* (2012.01)

(52) U.S. Cl.
CPC ..... *B28D 7/04* (2013.01); *B24B 49/00* (2013.01); *B28D 1/04* (2013.01); *B28D 1/048* (2013.01)

(58) Field of Classification Search
CPC ..... B24B 49/00; B24B 9/06; B24B 9/102; B28D 1/04; B28D 1/045; B28D 1/047; B28D 1/048; B28D 7/04
USPC ..... 451/5, 184, 336; 125/13.01, 14, 35
See application file for complete search history.

(56) References Cited

U.S. PATENT DOCUMENTS 2,747,565 A * 5/1956 Henderson ..... B23D 59/02 125/13.01
3,125,840 A * 3/1964 Cross ..... B65B 5/024 53/157
3,965,231 A * 6/1976 Depka ..... B28B 11/18 125/26
4,044,748 A * 8/1977 Villanueva ..... B23D 59/02 125/13.01
4,561,219 A * 12/1985 Harada ..... B24C 1/083 414/788.4
4,727,684 A * 3/1988 Kobayashi ..... B24B 31/02 241/137
5,512,005 A * 4/1996 Gulling ..... B24C 1/04 451/100
7,056,188 B1 * 6/2006 Triplett ..... B23D 47/045 125/13.01
7,121,920 B1 10/2006 Triplett et al.
7,232,361 B1 6/2007 Triplett et al.
7,648,409 B1 * 1/2010 Horiguchi ..... B24B 7/17 451/262
7,748,373 B2 * 7/2010 Toncelli ..... B28D 1/043 125/35
8,833,358 B1 * 9/2014 Robinson ..... B28D 1/08 125/16.02
9,138,914 B1 9/2015 Higgins
(Continued)

OTHER PUBLICATIONS

Park Industries, Precision. Performance. Peace of Mind. Thinstone TXS-5500 Thin Veneer Saw. http://www.parkindustries.com/products-solutions/architectural-fabrication/thinstone-veneer/txs-5500/#photos.

*Primary Examiner* — Eileen Morgan
(74) *Attorney, Agent, or Firm* — Stetina Brunda Garred and Brucker

(57) ABSTRACT

A masonry veneer machine is disclosed having adjustable fingers for applying the proper amount of pressure to the brick against a guide. The adjustable fingers are disposed on the lateral side of the saw blade, whereas, the guide is disposed on an arbor side of the saw blade. This provides for quick adjustments to the fingers and guide when changing over from cutting bricks of a first size to bricks of a second size which are significantly different from each other.

15 Claims, 10 Drawing Sheets

(56) References Cited

U.S. PATENT DOCUMENTS

| | | | | |
|---|---|---|---|---|
| 2005/0288161 | A1* | 12/2005 | Toncelli | B23C 1/002<br>483/31 |
| 2006/0084364 | A1* | 4/2006 | Toncelli | B28D 1/003<br>451/5 |
| 2010/0043771 | A1* | 2/2010 | Hiser | B28D 7/043<br>125/35 |
| 2012/0227726 | A1* | 9/2012 | Higgins | B28D 1/047<br>125/14 |

* cited by examiner

MASONRY VENEER MACHINE

CROSS-REFERENCE TO RELATED APPLICATIONS

The present application is a continuation patent application of U.S. patent application Ser. No. 14/151,740, filed on Jan. 9, 2014, the entire contents of which are incorporated herein by reference.

STATEMENT RE: FEDERALLY SPONSORED RESEARCH/DEVELOPMENT

Not Applicable

BACKGROUND

The various embodiments and aspects disclosed herein relate to a masonry veneer machine.

To fabricate a wall having a brick veneer, a plurality of brick tiles must be fabricated. The brick tiles are not full width bricks but are about a ½ inch thick. The brick tiles are cemented onto the wall. The brick tiles are cemented onto the wall. The brick tiles are cut from a normal sized brick with a saw blade. For example, an industrial sized chop saw may be used to cut one brick at a time. As such, the process for fabricating the plurality of brick veneer tiles is time-consuming and often dangerous.

Accordingly, there is a need in the art for an improved method and device for cutting bricks to fabricate a brick veneer tile.

BRIEF SUMMARY

The various embodiments and aspects disclosed herein address the needs discussed above, discussed below and those that are known in the art.

A masonry veneer machine is disclosed which provides for a safe and efficient means for reducing bricks of different widths to have a narrow width for fabricating a brick veneer tile. The machine may have two lines each of which processes the bricks separate and apart from each other. Each of the lines has a saw blade which are driven by a common motor. The motor is positioned vertically above a spindle to which the saw blades are attached to more efficiently transfer energy from the motor to the saw blade. Additionally, each of the lines has an adjustable finger assembly so that the proper amount of force may be applied to each brick being passed through the line. The adjustable finger assemblies are disposed on lateral sides of the saw blade. Also, each of the lines may have an adjustable guide to adjust the width of the brick veneer tile. The adjustable guides are disposed on an arbor side of the saw blade. Each of the lines also has a conveyor driven by a common motor. The motor drives the first slip clutch which in turn drives the conveyor of one of the lines. The motor also drives a second slip clutch which in turn drives the other line. If the brick is jammed in one of the lines, then the respective slip clutch prevents transfer of motion to the conveyor where the jam is located. This allows the other conveyor to continue to operate so that the unjammed line may be properly cleared and the machine shutdown to clear the jam.

More particularly, a machine for fabricating brick veneer tiles is disclosed. The machine may comprise a conveyor, a saw blade, a guide and a set of adjustable push fingers. The conveyor moves a brick from a loading section through a saw blade section to cut the brick to an unloading section.

The saw blade may be disposed above the conveyor at the saw blade section. The guide may be disposed on an arbor side of the saw blade. The set of adjustable push fingers may be disposed opposite the guide with respect to the saw blade for pushing the brick toward the arbor side and against the guide during operation of the machine.

Each of the adjustable push fingers may have a pinion gear. The machine may further comprise a rack traverseable in a direction of movement of the conveyor. The rack may be engaged to the pinion gears of the adjustable push fingers for rotating the adjustable push fingers by traversing the rack forward or rearward and adjusting pressure that the adjustable push fingers apply to the brick by incrementally traversing the rack forward or rearward.

Each of the adjustable push fingers can be lifted out of engagement with the rack and rotationally repositioned to increase or decrease the pressure such adjustable push finger applies to the brick.

The machine may further comprise a sensor disposed upstream of the saw blade for sensing a position of a lateral side of the brick. The sensor may be operative to send a signal to a stepper motor for incrementally traversing the rack forward or rearward to adjust tension of the adjustable push finger for the upcoming brick to be cut by the saw blade.

The machine may further comprise an auto feeder system having a sensor for sensing a position of the conveyor and an actuator for advancing the brick from the auto feeder system onto the conveyor. The sensor may be a mechanical sensor for sensing a cleat of the conveyor. The actuator may be a conveyor or solenoid.

The guide may be rotatable closer to or further away from the saw blade for adjusting a thickness of the veneer tiles.

In another aspect, a machine for fabricating brick veneer tiles is disclosed. The machine may comprise first and second conveyors, first and second saw blades, first and second guides, first and second sets of adjustable push fingers, a saw blade motor and a belt. The first and second conveyors moves bricks from loading sections through saw blade sections to cut the bricks to unloading sections. The first and second saw blades may be respectively disposed above the first and second conveyors at the saw blade sections. The first and second guides may be disposed on an arbor side of the first and second saw blades. The first and second sets of adjustable push fingers may be disposed opposite the respective first and second guides with respect to the first and second saw blades for pushing the bricks toward the arbor side and against the guides during operation of the machine. The saw blade motor may be vertically aligned to the arbor. The belt may be attached to the arbor and the blade for transferring motion from the motor to the arbor.

An output shaft of the saw blade motor may be disposed directly above the arbor.

The machine may further comprise a conveyor motor. The machine may further comprise first and second slip clutches respectively attached to the conveyor motor and the first and second conveyors so that the first and second conveyors continue to run even if the other conveyor is jammed.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
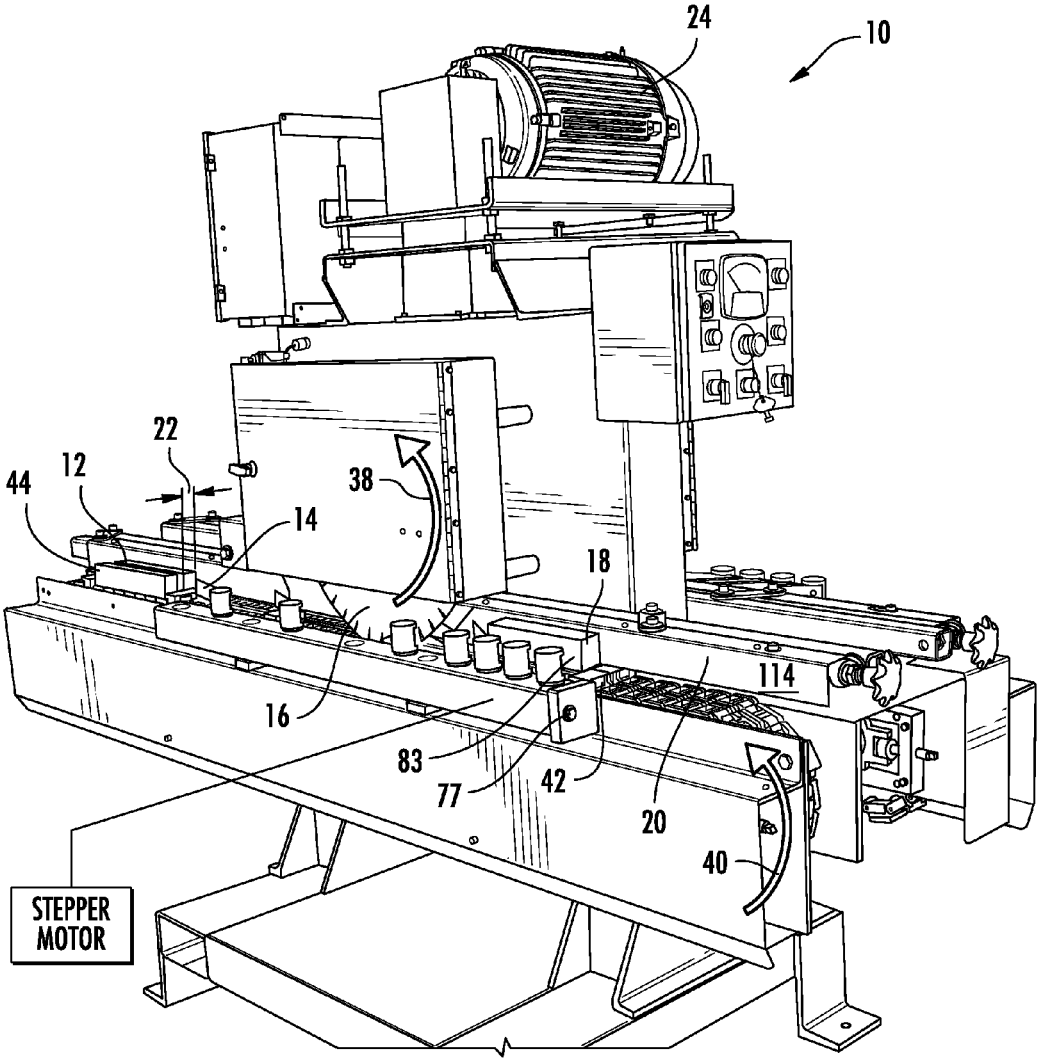
FIG. 1 is a front perspective view of a masonry veneer machine.

Referring now to the drawings, a masonry veneer machine 10 is shown. The machine 10 is capable of producing a veneer tile 12 in a safe and efficient manner to provide for high throughput. The machine 10 has a plurality of adjustable pressure applying fingers 14 on lateral sides of saw blades 16. The fingers 14 press a brick 18 against an adjustable guide 20 which is disposed on a medical or arbor side of the saw blades 16. The adjustable guide 20 may be traversed closer to or further away from the saw blade 16 to adjust a thickness 22 of the veneer tile 12. The adjustable fingers 14 and guide 20 allow the machine 10 to accommodate a wider range of brick sizes and also for quicker changeovers, if necessary to cut bricks 18 of a larger or smaller size outside of the current range. Other features are also incorporated into the machine 10 that allow the machine 10 to have a small footprint and a high throughput. By way of example and not limitation, the machine 10 has a motor 24 that is vertically positioned above a spindle 26 of the saw blade 16 to provide for a more efficient transfer of energy from the motor 24 to the spindle 26. Additionally, the motor 24 drives two saw blades 16 on both sides of the machine 10. The machine 10 may also be fitted with sensors and actuators for machine loading and on-the-fly adjustments to the fingers 14 to apply the proper amount of pressure to the brick 18 approaching the saw blade 16 and then readjusting the fingers 14 based on the size of the next upcoming brick 18.

Figure 2:
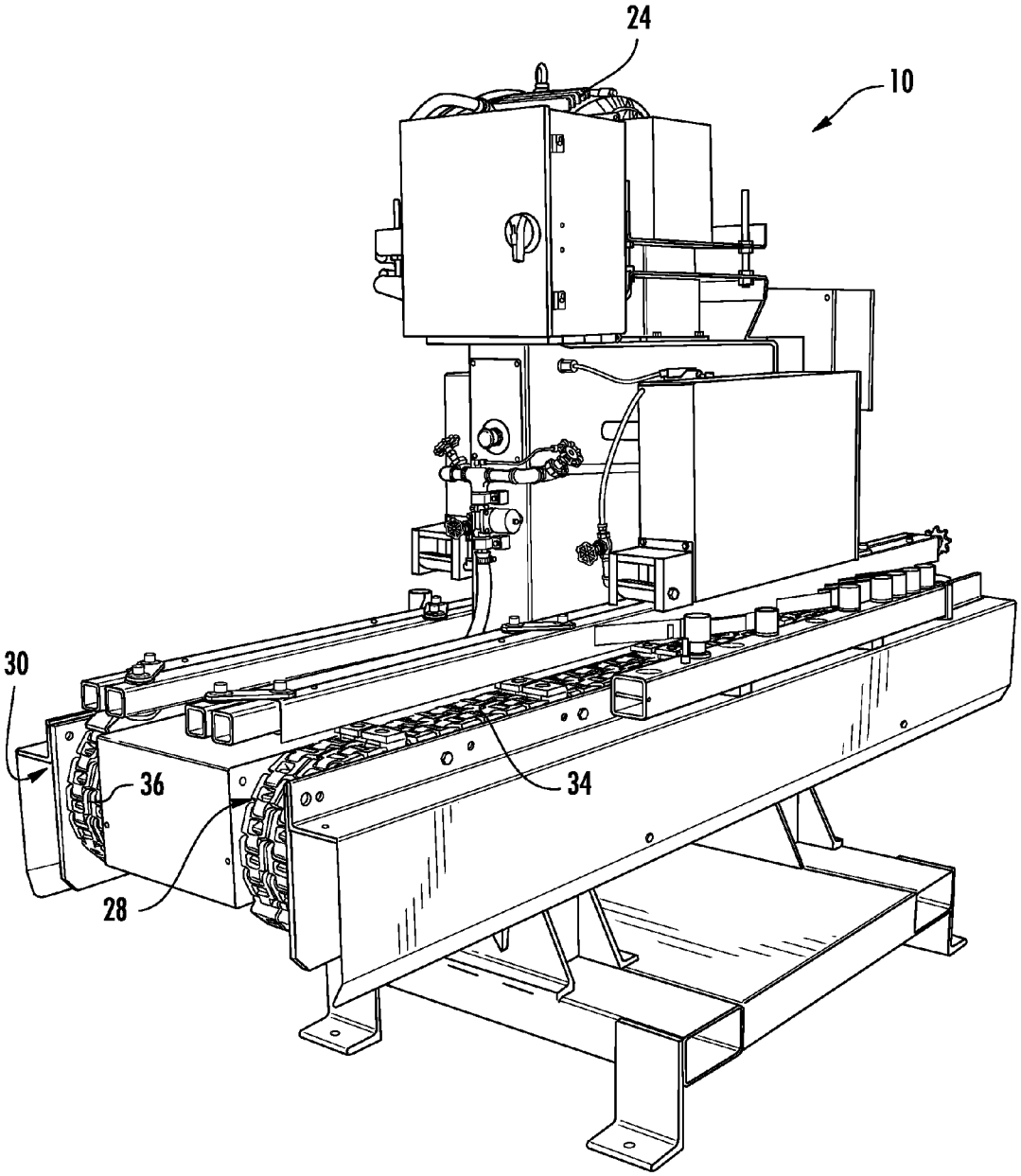
FIG. 2 is a rear perspective view of the masonry veneer machine shown in FIG. 1.

More particularly, referring now to FIGS. 1 and 2, the machine 10 has two lines 28, 30. Each line 28, 30 has a saw blade 16 that cuts a brick 18 independent of the other line 28, 30. Both saw blades 16 are driven by the same motor 24. Additionally, a motor 32 rotates two conveyors 34, 36 (one conveyor 34, 36 for each line 28, 30) to traverse a plurality of bricks 18 along each of the lines 28, 30. During operation, the motor 24 rotates the saw blades 16 in the direction of arrow 38, while motor 32 rotates the conveyors 34, 36 in the direction of arrow 40. It is also contemplated that the motor 24 may rotate the saw blades 16 in the opposite direction as well. To fabricate a veneer tile 12, an operator places a brick 18 in front of a cleat 42 attached to the conveyor 34, 36. The operator may place one brick 18 in front of each upcoming cleat 42 on each of the lines 28, 30. As the conveyors 34, 36 rotate in the direction of arrow 40, the cleats 42 push the brick 18 toward the saw blades 60. The fingers 14 push the brick 18 against the guide 20 before the brick 18 reaches the saw blade 16. When the brick 18 passes through the saw blade 16, the brick 18 is rip cut into two pieces, namely, a veneer tile 12 and a leftover portion 44. If the leftover portion 44 can be recut to produce a second veneer tile 12, then the leftover portion 44 is placed upstream of the saw blade 16 and in front of an upcoming cleat 42. The veneer tile 12 is unloaded from the machine 10 typically onto a pallet (not shown).

Figure 3A:
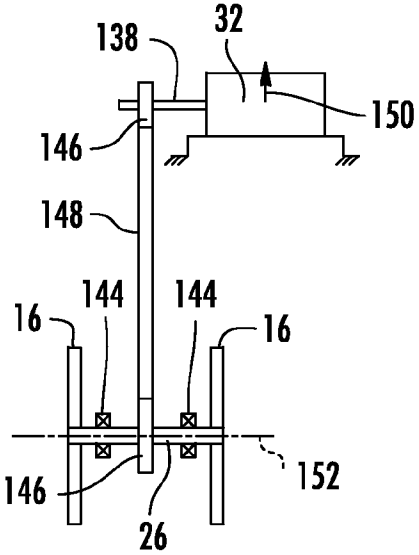
FIG. 3A is a front view of the masonry veneer machine shown in FIG. 1.
Figure 3:
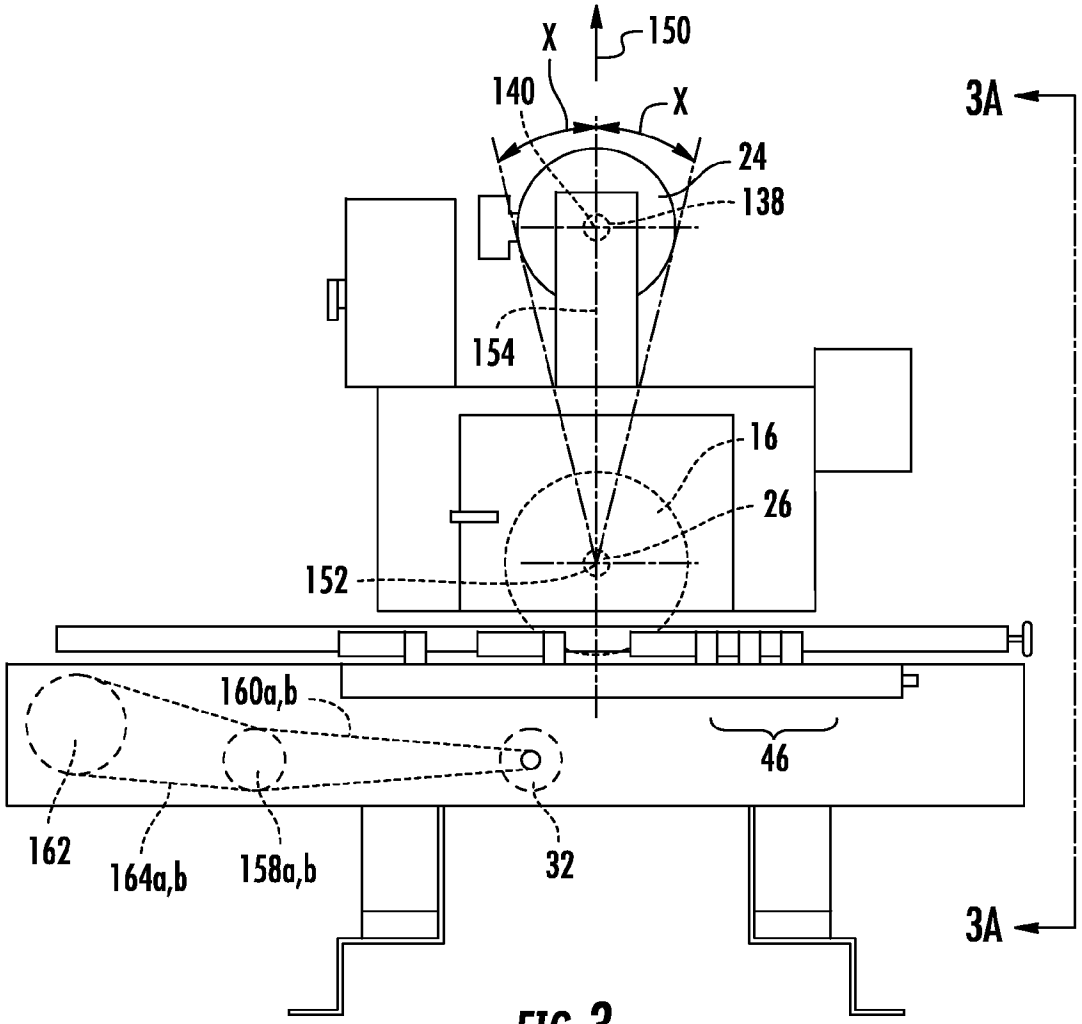
FIG. 3 is a side view of the masonry veneer machine shown in FIG. 1.

Referring now to FIG. 3, a side view of the machine 10 is shown. A plurality of fingers 14 are positioned at an upstream section 46 of the saw blade 16. The fingers 14 at the upstream section 46 push the brick 18 against the guide 20 to regulate a thickness 22 of the veneer tile 12. One or two more fingers 14 may be positioned downstream of the saw blade 16 to help maintain the veneer tile 12 and the leftover portion 44 on the conveyors 34, 36 after being cut by the saw blades 16.

Figure 4:
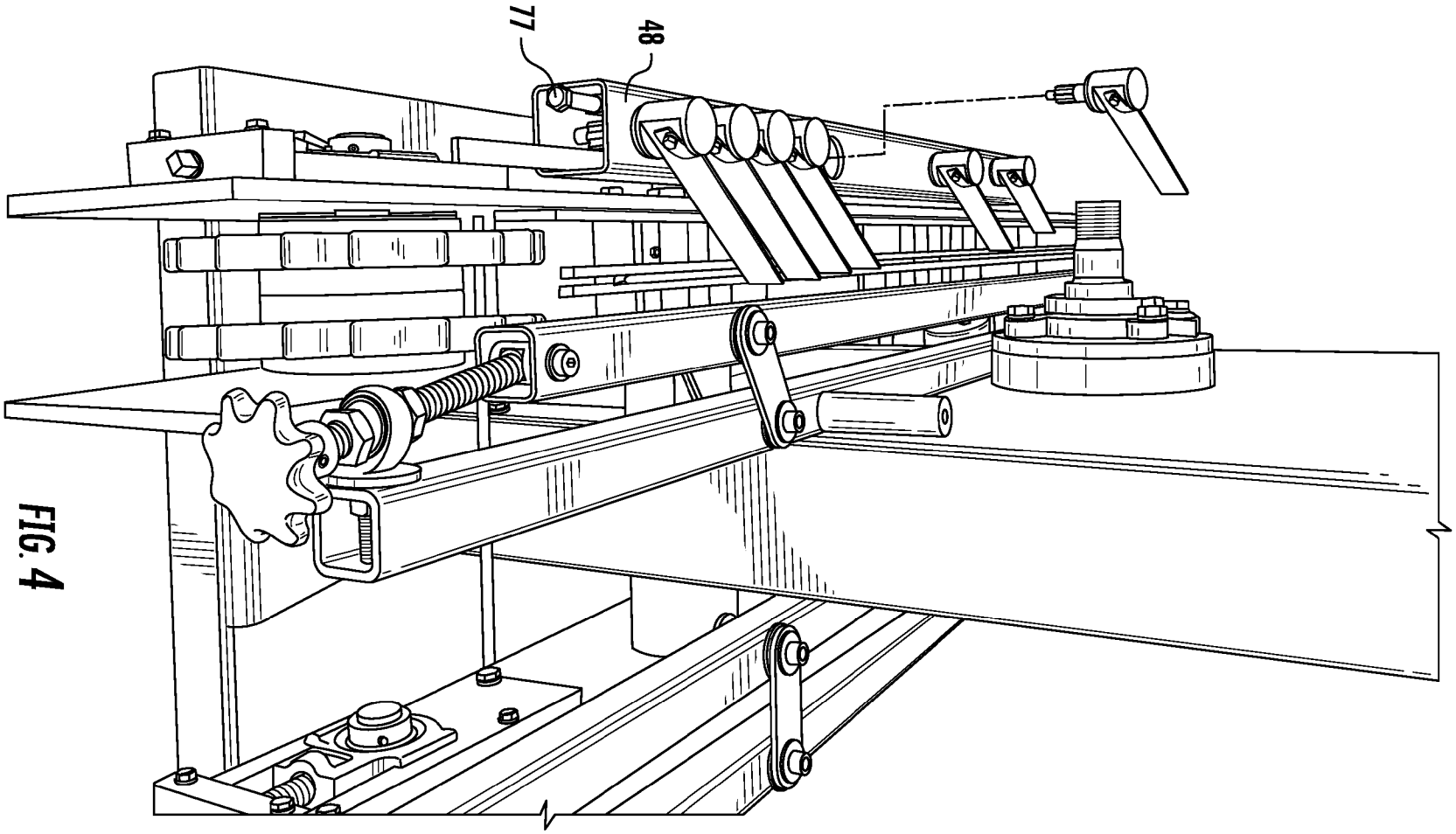
FIG. 4 is a partial disassembled view of the masonry veneer machine shown in FIG. 1 illustrating fingers and a guide.
Figure 4A:
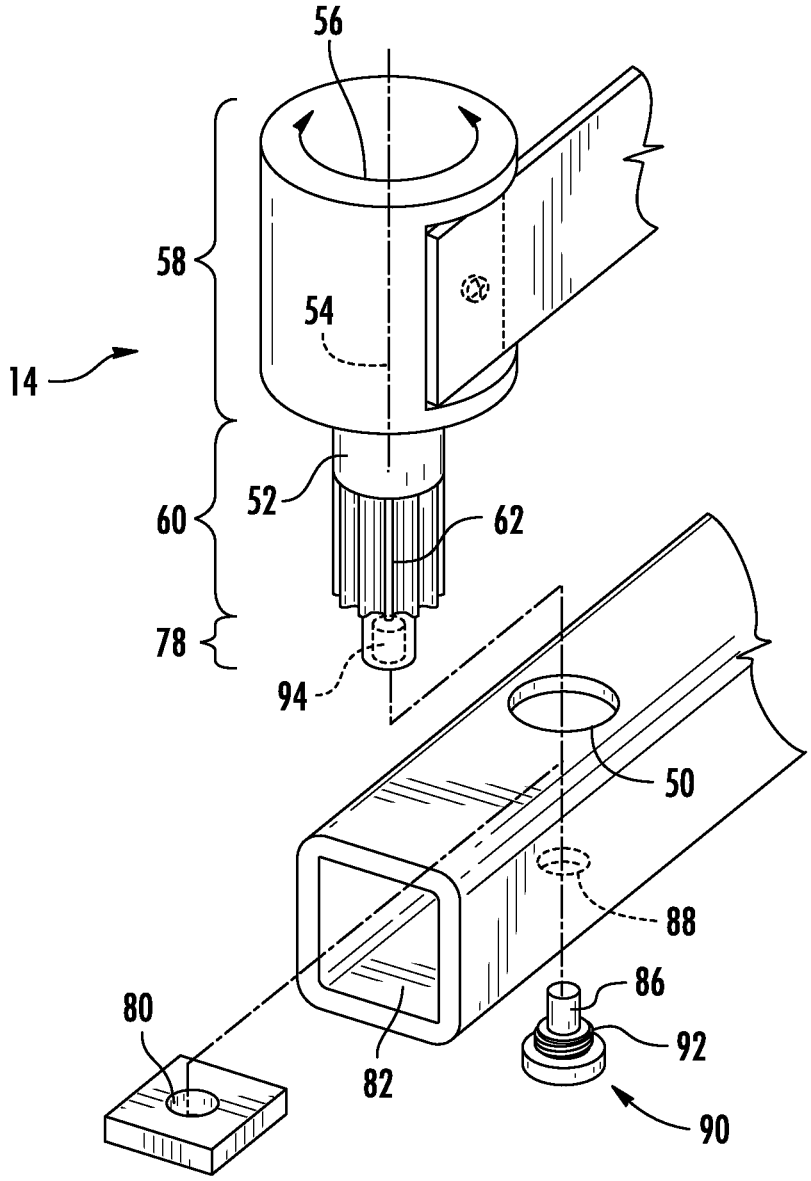
FIG. 4A is an exploded perspective view of the finger and a finger mounting fixture.
Figure 5:
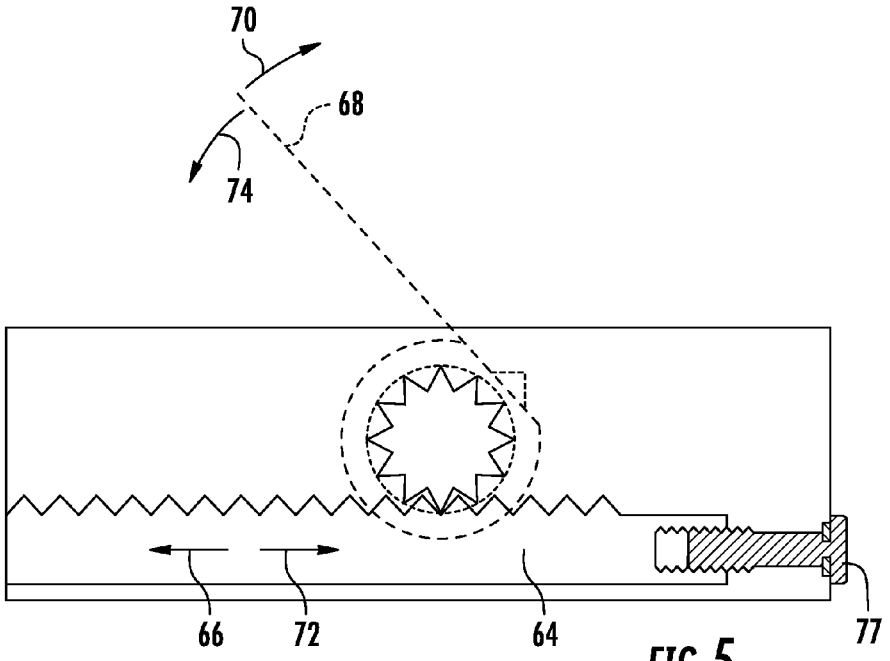
FIG. 5 is a cross-sectional view of the finger and the finger mounting fixture shown in FIG. 4A illustrating a rack and pinion connection for adjusting an angular orientation of the tines of the fingers.

Referring now to FIGS. 4 and 5, the fingers 14 may be mounted to an elongate mounting fixture 48. The fingers 14 may be removably attachable to the elongate mounting fixture 48. In particular, the elongate mounting fixture 48 may be a square tube. A hole 50 may be formed in the top side of the square tube. The thickness of the tube receives a neck 52 of the finger 14. The size of the neck 52 is sized and configured to have a snug fit with the inner diameter of the hole 50 but still allow the finger 14 to freely rotate. The fingers 14 are capable of rotating about axis 54 in direction 56. The fingers 14 can rotate and be set at a particular angular orientation so that tines 68 of the fingers 14 can apply the proper amount of pressure to the brick 18 being traversed through line 28, 30. The upper portion 58 of the finger 14 is larger than the neck 52 so that a bottom surface rests on the top side of the tube when the neck 52 is received in the hole 50. The lower portion 60 includes the neck 52 and a pinion gear 62. The pinion gear 62 engages a rack 64 that is disposed within the tube. The rack 64 extends along the tube so that all of the pinion gears 62 of the plurality of fingers 14 engage the rack 64. If the rack 64 is traversed in the direction of arrow 66, then the tine 68 of the finger 14 is rotated in the direction of arrow 70 to apply more pressure to the brick 18. Conversely, if the rack 64 is traversed in the direction of arrow 72, then the tine 68 of the finger 14 is rotated in the direction of arrow 76 to apply less pressure to the brick 18.

To adjust the pressure that the fingers 14 apply to the brick 18, the operator can turn a bolt 77. The bolt is engaged to the rack 64 so that turning the bolt in one direction would pull the rack 64 closer to the bolt and turning the bolt in the opposite direction would push the rack further away from the bolt. By traversing the rack 64 closer to or further away from the bolt 64, the pinion 62 will rotate which also in turn angularly positions the tines 68. Additionally, traversing the rack 64 rotates all of the fingers the same amount.

It is further contemplated that the bolt 77 may be rotated with a stepper motor 81 based on a proximity sensor 79. In particular, the proximity sensor 79 is positioned to sense an edge or lateral surface 83 of the brick 18 to be cut. The proximity sensor 79 is positioned upstream of the saw blade 16 and within or after the upstream section 46 of the fingers 14 so that the sensor 79 senses the edge or lateral surface 83 of the brick after the brick 18 is pushed against the guide 20. The sensor 79 senses the edge or lateral surface 83 of the brick 18 and provides the information to a processor which calculates the position of the edge or lateral surface 83 of the brick 18 with respect to other bricks 18. If a wider brick is approaching the saw blade 16, then the processor controls the stepper motor 81 to push or pull the rack 64 as the case may be in order to rotate and position the fingers 14 at the proper angular position so that the tines 68 of the fingers 14 apply the proper pressure to the upcoming brick. If a narrower brick is approaching the saw blade 16, then the process controls the stepper motor 81 to push or pull the rack as the case may be in order rotate and position the fingers 14 at the proper angular position so that the tines 68 of the fingers 14 apply the proper pressure to the upcoming brick 18.

To further stabilize the fingers 14, the bottom of the finger 14 may have a peg 78. The peg 78 may be received into an alignment hole 80 at the bottom of the tube defining the mounting fixture 48. The alignment hole 80 is formed in a block 84 that is attached (e.g., welded, bolted) to a bottom surface 82 of the tube. The alignment hole 80 is disposed immediately below the hole 50 so that the hole 50 and the alignment hole 80 vertically positions the finger 14 and the tine 68 extends flush against the side of the brick 18.

Alternatively, the peg 78 may alternatively receive a pin 86 in the following manner. The lower surface 82 may have a threaded aperture 88. A nut 90 having a pin 86 may be formed on the distal end of the nut 90. Threads 92 of the nut 90 are threaded into the threaded aperture 88. Upon doing so, the pin 86 is received into a recess 94 formed in the peg 78. The threaded hole 88 and the pin 86 of the nut 90 vertically align with the hole 50 formed in the tube defining the mounting fixture 48.

Figure 4B:
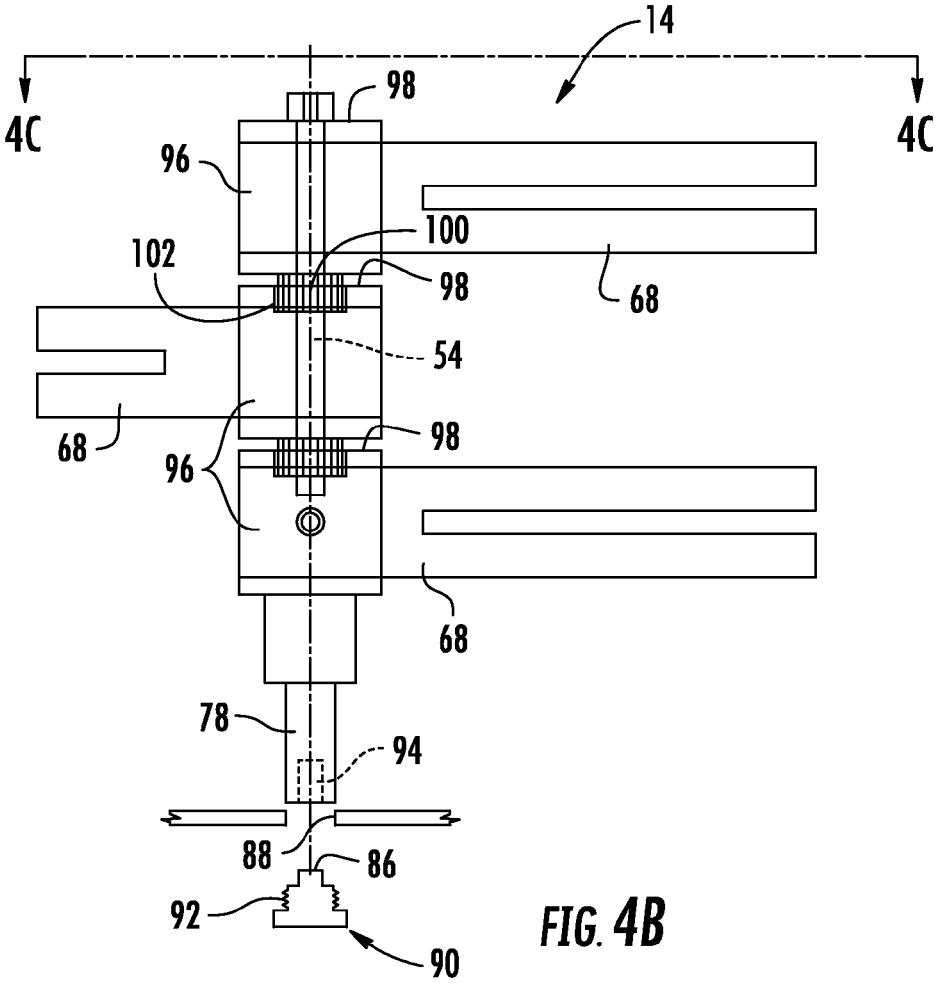
FIG. 4B is an alternate finger assembly for providing for a taller finger.
Figure 4C:
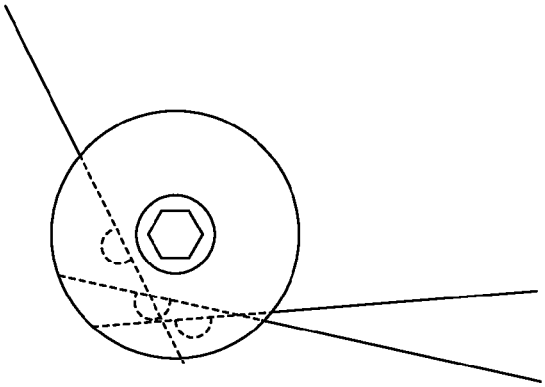
FIG. 4C is a top view of the finger assembly shown in FIG. 4B.

Referring now to FIG. 4B, the finger 14 may be adjustable in height. In particular, additional tine(s) 68 may be stacked upon the lowest tine 68. Additionally, each of the tines 68 may be aligned vertically to each other or may be aligned separately from each other as shown in FIGS. 4B and 4C. The bottom side of each of the bodies 96 may have a hex or gear 98 extending below. The hex or gear 100 may be fitted into a corresponding mating ring 102. The angular position of each of the tines 68 about vertical axis 54 may be adjusted by disengaging (i.e., lifting up the upper body 96 to disengage the lower set of gears 100 and ring 102) setting the angular orientation of the tine 68 by re-engaging the lower set of gears 100 and ring 102. To lock the entire stack of bodies 96 together, a bolt 104 may extend through the upper bodies 96 and then be threaded into the lowest most body 96. Accordingly, the fingers 14 may be used to push larger pieces of masonry against the guide 20. When a taller finger 14 is used, then a corresponding taller guide 20 may be installed on the machine 10.

It is also contemplated that each finger or each stack of fingers may be adjusted rotationally about its respective axis 54 separate and apart from the other fingers along the line 28, 30. To this end, a motor (e.g., stepper motor or servo motor) may be attached to the pinion gear 62 and be operative to rotationally adjust the finger or the stack of fingers separate and apart from the other fingers along the line 28, 30.

Figure 6:
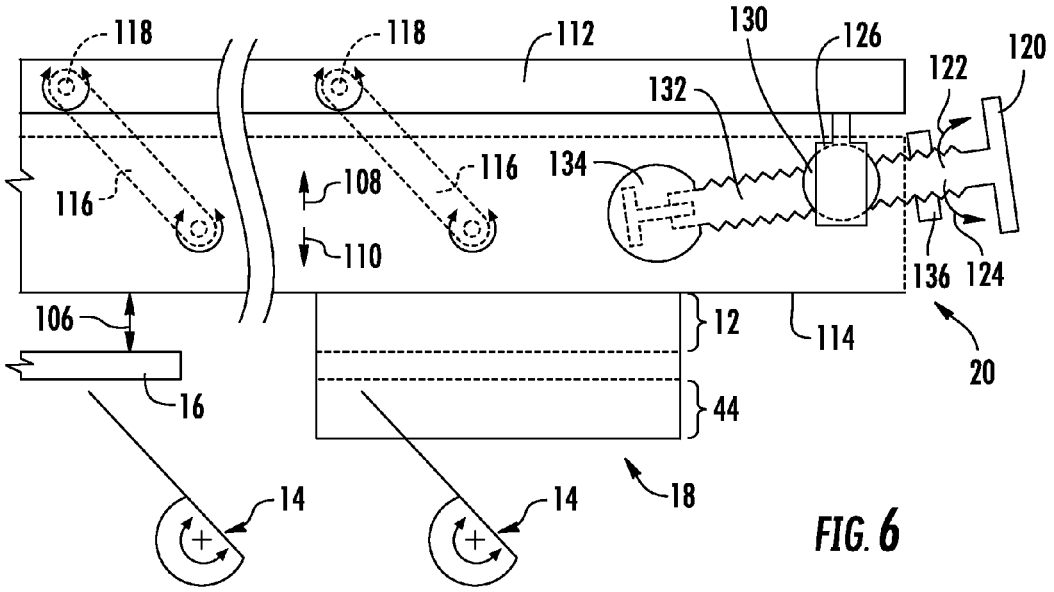
FIG. 6 is a top cross-sectional view of the guide illustrating adjustability of the guide to a saw blade.

Referring now to FIG. 6, the guide 20 is adjustable so that a distance 106 between the saw blade 16 and the guide 20 can be made larger or smaller depending on the desired width of the veneer tile 12. To increase the distance 106, the guide 20 may be moved further away from the saw blade 16 in the direction of arrow 108. Conversely, to decrease the distance 106, the guide 20 may be moved closer to the saw blade 16 in the direction of arrow 110. To increase or decrease the distance 106, the guide 20 may be pivotably secured to a frame 112 of the machine 10 with the linkages 116. The guide 20 may have a face 114 which contacts the brick 18 as a conveyor traverses the brick 18 closer to the saw blade 16. The fingers 14 push the brick 18 against the face 114 of the guide 20. The guide 20 may be an L bracket or have an L configuration, as shown in FIG. 1. The top side of the L bracket may be secured to the frame 112 with two or more linkages 116. The linkages 116 rotate about the frame 112. Also, the linkages 116 are pivotable to the top side of the guide 20. The guide 20 can rotate about the frame 112 in relation to pivot points 118 defined by the rotatable connection between the frame 112 and the linages 116. The linkages 116 have the same length as the guide 20, and more particularly the face 114 of the guide 20 maintains a parallel relationship to the saw blade 16 when the guide 20 is traversed closer to 110 or further away 108 from the saw blade 16.

To move the face 114 of the guide 20 closer to the saw blade 16, a handle 120 is rotated in the direction of arrow 122. Conversely, to move the face 114 of the guide 20 further away from the saw blade 16, the handle 120 is rotated in opposite direction, namely, in the direction of arrow 124. The handle 120 is threadedly connected to a first fixture 126 and rotatably connected to a second fixture 128. The first fixture 126 is fixedly connected to the frame 112 of the machine 10. A spherical body 130 is rotatably disposed within the first fixture 26. The handle 120 is connected to a threaded rod 132 which is threadedly engaged to a threaded hole formed in the spherical body 130. By rotating the handle 120 in the direction of arrows 122, 124, the threaded rod 132 is threaded further into or further out of the spherical body 130. The distal end of the threaded rod 132 may be rotatably connected to the top side of the guide 20 in any manner known in the art or developed in the future. By way of example and not limitation, the distal end of the threaded rod 132 may be secured to a cylinder 134. The cylinder 134 may be pivotally connected to the top side of the guide 20. By rotating the handle 120 in the direction of arrows 122 and 124, the threaded rod 132 pushes the guide 20 away or closer to the first fixture 126. This in part rotates the guide 20 about pivot point 118. As discussed above, pivoting the guide 20 about pivot point 118 traverses the guide 20 closer to or further away from the saw blade 16. As the handle 120 is rotated in the direction of arrows 122, 124, the spherical body 130 rotates within the first fixture 126 that has a corresponding spherical cavity which retains the spherical body 130 in the first fixture 126. To lock the position of the guide 20, a lock nut 136 may be jammed against the spherical body 130.

Figure 7:
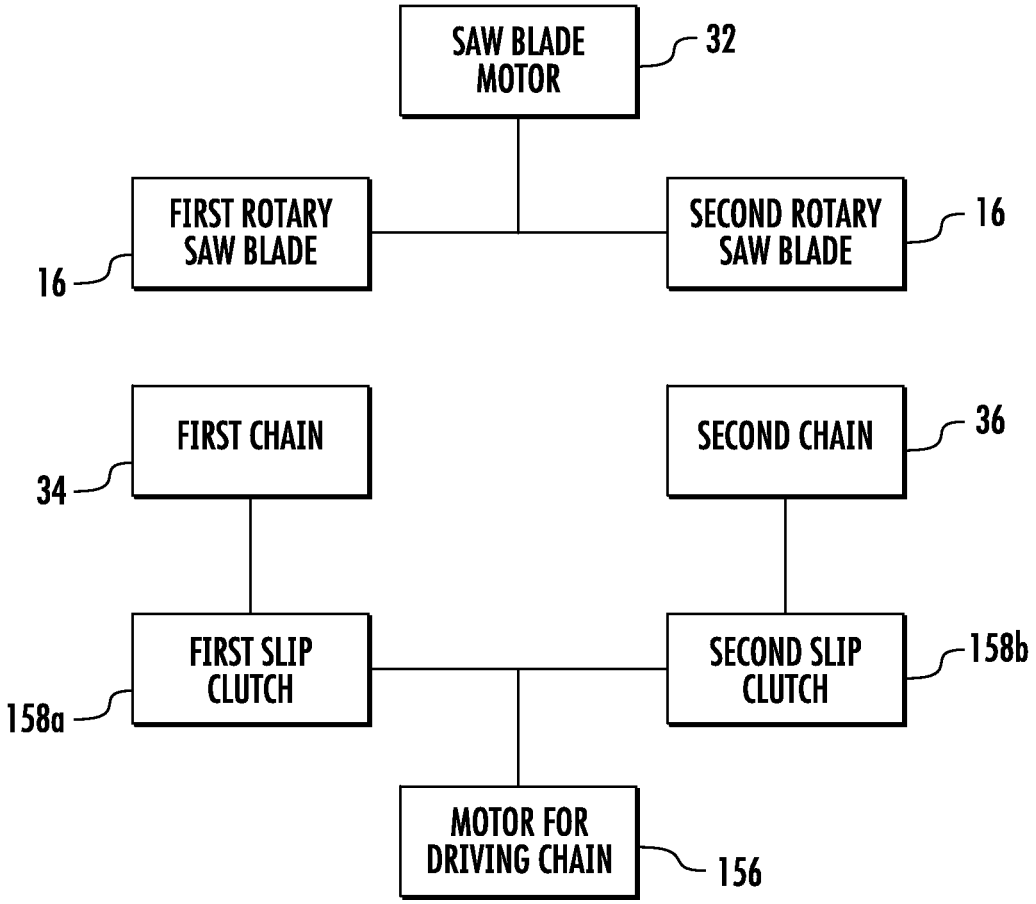
FIG. 7 is a schematic view of the motors and the saw blades and conveyors of the masonry veneer machine.

Referring now to FIGS. 3, 3A and 7, the motor 24 of the saw blade 16 is positioned vertically above the saw blade 16. In particular, the motor 24 has an output shaft 138 that rotates about a rotating axis 140. The machine 10 may have left and right saw blades 16, as shown in FIG. 3A. The left and right saw blades 16 may be mounted to a common spindle 26. The spindle 26 is rotatably mounted to the frame 112 with a pair of bearings 144. The output shaft 138 of the motor 32 and the spindle 26 both have pulleys 146. The pulleys 146 are sized and configured to provide the right speed and transfer of energy from the motor 32 into the saw blades 16. A belt or other energy transmission device 148 may be wrapped around the pulleys 146 of the output shaft 138 and spindle 26 to transfer the motion of the output shaft 138 of the motor 32 to the axle 142 and ultimately to the saw blades 16. If a vertical plane 154 is drawn intersecting the rotating axis 152 of the spindle 26, then the motor 32 is said to be positioned vertically above the saw blade 16 if an angle X of the rotating axis 140 of the output shaft 138 to such vertical plane 154 is within ±10°, and more preferably within ±5°. Additionally, referring to FIG. 3A, the belt 148 extends vertically upward and the pulley 146 attached to the spindle 26 is disposed at a midpoint between the two saw blades 16. To tension the belt 148, the motor 32 may be raised in direction of arrow 150 which is vertically upwards. In this manner, energy transfer from the motor 32 to the saw blades 16 is efficient. Moreover, the weight of the saw blades 16 and the spindle 26 helps to further tension the belt 148 and mitigate any inefficiencies.

Additionally, the belt 148 may be disposed at a midpoint between the saw blades 16 so that the weight of the spindle 26 and the saw blades 16 are balanced on the belt 148. In this manner, the transfer of energy between the motor 24 and the spindle 26 is increased.

Referring now to FIGS. 3 and 7, a motor 156 drives both of the conveyors 34, 36. The motor 156 is physically connected to first and second slip clutches 158*a, b*. The slip clutch 158*a* drives the first conveyor 34. The slip clutch 158*b* drives the second conveyor 36. During operation of the machine 10, bricks 18 are fed through the machine on the first and second conveyors 34, 36 independently of each other. In certain instances, the brick 18 may become jammed between the saw blade 16 and the guide 20. When the brick 18 becomes jammed, the brick 18 may prevent movement of the conveyor 34 or 36. If the brick 18 prevents movement of the conveyor 34 or 36, then the appropriate slip clutch 158*a* or 158*b* disconnects the transfer of energy from the motor 156 to the first or second conveyors 34 or 36 where the brick 18 is jammed. In this manner, when the jam occurs, the other functioning line 28 or 30 can still be utilized without significantly impacting throughput of bricks 18 through the machine 10. The functioning line 28 or 30 can be allowed to cut the bricks 18 already on the conveyor 34 or 36. Once all of the bricks 18 already on the conveyor 34 or 36 are cut, then the machine 10 can be shut down to clear the nonfunctioning line 28 or 30. Referring now to FIG. 3, the motor may impart rotational motion to the slip clutches 158*a, b* with first and second chains 160*a, b*. Additionally, the slip clutch 158*a, b* may be attached to pulleys 162*a, b* with chains 164*a, b* to rotate the conveyors 34, 36.

Each of the slip clutches 158*a, b* may be also adjusted to slip at the same or different rates for the purpose of controlling the speed of the respective lines 28, 30. By way of example and not limitation, the line 28 can cut bricks having a different hardness compared to bricks being cut on line 30. The slip clutch for the line with the harder bricks may be provided with more slip compared to slip clutch for the line with the softer bricks. By doing so, the line with the harder bricks will run at a slower pace compared to the line with the softer bricks.

Figure 8:
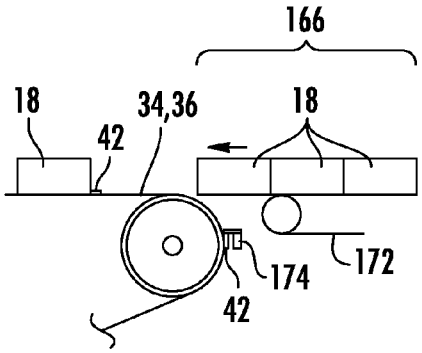
FIG. 8 illustrates a first embodiment of a brick loading system for the masonry veneer machine.

Referring now to FIGS. 8-10, brick loading systems 166, 168 and 170 are shown. More particularly, referring now to FIG. 8, the brick loading system 166 includes a conveyor 172 that is disposed upstream of each of the conveyors 34, 36. The conveyor 172 allows the bricks 18 to be laid end-to-end one right behind the other. As the conveyor 34, 36 rotates, cleats 42 which are spaced apart from each other on the conveyors 34, 36 approach the start of the line 28, 30. After one of the cleats 42 advances a brick 18, the conveyor 172 advances a brick so that the brick engages the conveyor 34, 36 due to the weight of the brick 18. Friction between the conveyors 34, 36 of the brick 18 advances the brick 18 forward as the conveyor 34, 36 rotates forward. When the fingers 14 push the brick 18 against the guide 20, the brick 18 may slip on top of the conveyor 34, 36 because the friction caused between the fingers 14 and guide 20 is greater than the friction between the brick and the conveyors 34, 36 due to the weight of the brick 18. As the brick 18 stalls, the cleats 42 approach the backside of the brick 18 and push the brick 18 forward between the fingers 14 and the guide 20 and ultimately through the saw blade 16. The conveyor 172 may be toned to the conveyor 34, 36 and more particularly to the cleats 42. For example, the conveyor 172 may advance a brick 18 forward only when a sensor 174 senses a cleat 42. As such, the intermittent forward motion of the conveyor 172 is timed to the sensing of the cleat 42.

Figure 9C:
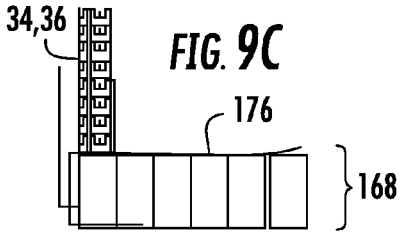
FIG. 9C is a top view of the second embodiment of the brick loading system shown in FIG. 9A.
Figure 9A:
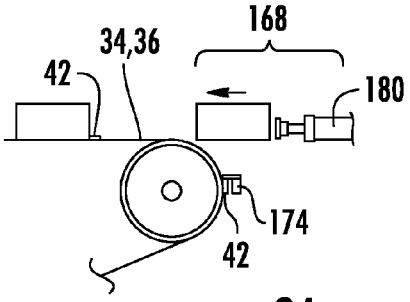
FIG. 9A is a side view of a second embodiment of the brick loading system for the masonry veneer machine.
Figure 9B:
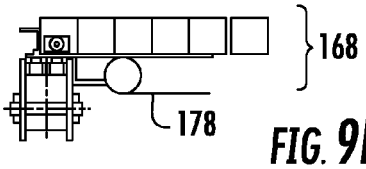
FIG. 9B is a rear view of the second embodiment of the brick loading system shown in FIG. 9A.

Referring now to FIGS. 9A-9C, side, rear and top views of the brick loading system 168 are shown. In FIG. 9C, the brick loading system 168 is disposed upstream of each of the conveyors 34, 36. In FIG. 9C, bricks 18 may be laid side-by-side in a cassette 176. The bricks 18 may extend to the left when the brick loading system 168 is used to load bricks 18 onto the line 28. The bricks 18 may extend to the right when the brick loading system 168 is used to load bricks 18 onto line 30. The cassette 176 may align the bricks 18 on conveyor 178. At the appropriate time, a pusher 180 advances the brick 18 onto the conveyor 34, 36. The conveyor 178 intermittently advances the brick 18 in line with the conveyor 34, 36 after the pusher 180 pushes the brick 18 onto the conveyor 34, 36. The pusher 180 pushes the brick 18 onto the conveyor 34, 36 in between two cleats 42. The cleats 42 are spaced apart from each other on the conveyor 34, 36 at known intervals. Additionally, the speed of the conveyor 34, 36 is also a known variable. When the sensor 174 senses the cleat 42, the pusher 180 may push the brick 18 onto the conveyor 34, 36 immediately or after a predetermined period of time based on the known spacings between the cleats 42 and the known speed of the conveyor 34, 36 so that one brick 18 is placed between adjacent cleats 42. Once the pusher 180 pushes the brick 18 onto the conveyor 34, 36 and the arm of the pusher 180 is retracted, the conveyor 178 advances the brick 18 in the cassette 176 in line with conveyor 34, 36. The process is repeated for each cleat 42 that passes the sensor 174.

Figure 10C:
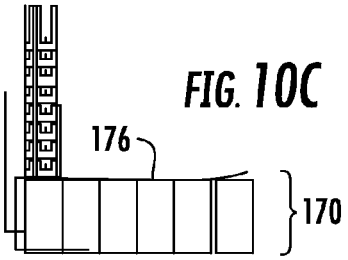
FIG. 10C is a top view of the third embodiment of the brick loading system shown in FIG. 10A.
Figure 10A:
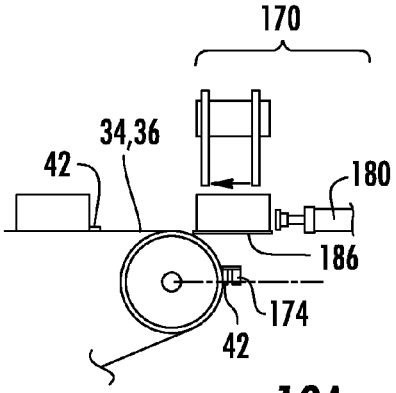
FIG. 10A is a side view of a third embodiment of the brick loading system for the masonry veneer machine.
Figure 10B:
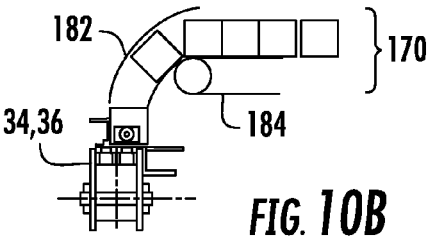
FIG. 10B is a rear view of the third embodiment of the brick loading system shown in FIG. 10A.
Figure 11:
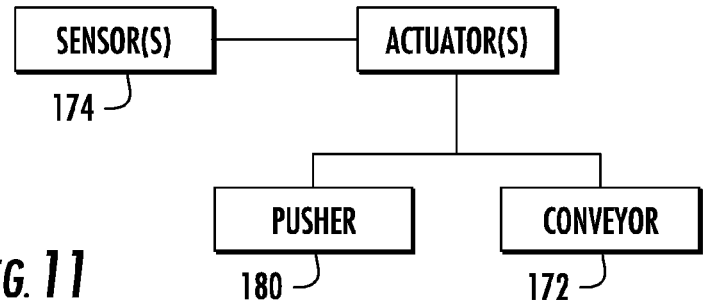
FIG. 11 is a schematic view of a feedback sensor for synchronizing the brick loading system to the masonry veneer machine.

Referring now to FIGS. 10A-10C, side, rear and top views of the brick loading system 170 are shown. In FIG. 10C, the brick loading system 170 is shown as being disposed upstream of each conveyor 34, 36. Moreover, the bricks 18 are laid side-by-side in a cassette 176. The cassette 176 is disposed above the plane of the conveyor 34, 36 so that one brick 18 may be disposed on a platform 186 in front of or upstream of the conveyor 34, 36. In particular, the cassette 176 feeds the bricks 18 into a chute 182. The conveyor 184 intermittently advances the bricks toward the conveyor 34, 36. The conveyor 184 traverses the bricks 18 just enough for one brick 18 to fall through the chute 182 by way of gravity and be positioned on the platform 186. Only one brick 18 is on the platform 186 when the pusher 180 pushes that brick onto the conveyor 34, 36. During operation, the pusher 180 and the conveyor 184 sync the passage of the cleats 42 past sensor 174. In particular, the spacing between the cleats 42 is known. Also, the speed of the conveyor 34, 36 is known. Once a sensor 174 senses a cleat 42, the pusher 180 is timed so that the brick 18 on the platform 186 pushes the brick 18 between adjacent cleats 42. Once the brick 18 is off of the platform 186, the conveyor 184 rotates just enough to allow the next brick 18 to fall through the chute 182 and onto the platform 186. The brick loading system 170 waits until the next cleat 42 is sensed or timed by the prior cleat 42 so that the brick 18 on the platform 186 is pushed by the pusher 180 between the cleats 42.

The masonry veneer machine 10 and the various aspects and embodiments disclosed therein related to the machine 10 have been described in relation to fabricating a brick veneer tile. However, the masonry veneer machine 10 may also be utilized to cut masonry blocks of various sizes. Accordingly, the fingers may be taller to provide even pressure against larger masonry blocks to push larger masonry blocks against the guide 20. Moreover, it is further contemplated that other types of materials may be cut using the masonry veneer machine such as wood, plastic and polymer. For lighter materials, a hold down bar 188 (see FIGS. 12 and 13) may be disposed above the individual blocks to hold the individual blocks down as the saw blades 16 cut into the individual blocks.

Figure 12:
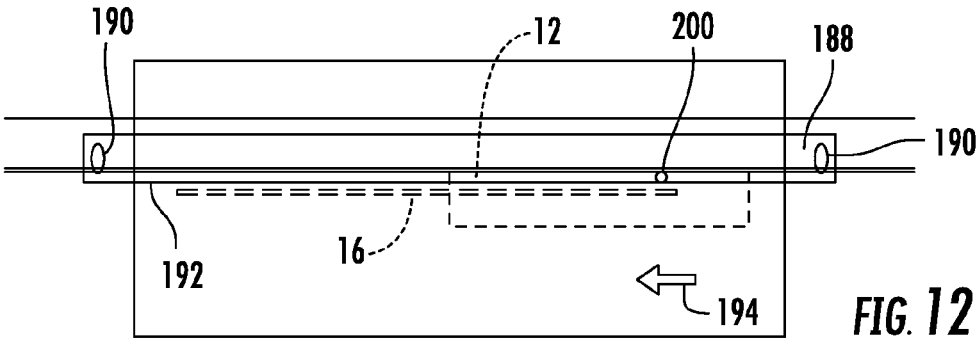
FIG. 12 is a top view of a blade of the masonry veneer machine with a liquid lubrication system.
Figure 13:
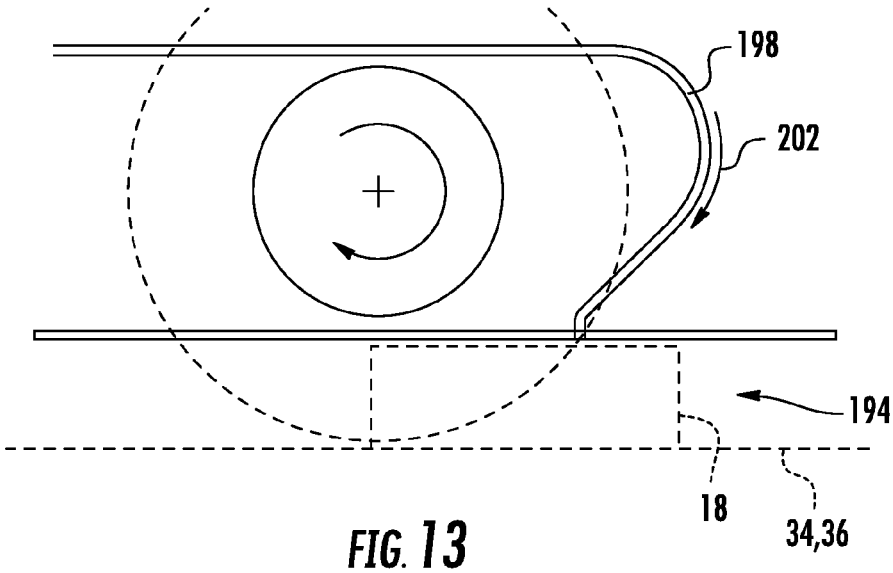
FIG. 13 is a side view of the blade of the masonry veneer machine and the liquid lubrication system.

Referring now to FIGS. 12 and 13, the hold down bar 188 may be attached to the top side of the guide 20 with bolts (not shown) fed through the slotted holes 190. The bolts clamp the hold down bar 188 to the top side of the guide 20. This allows the user to adjust the position of the lateral edge 192 of the hold down bar 188 so that the lateral edge 192 of the hold down bar 188 is disposed closely adjacent to the medial side of the saw blade 16. The bricks 18 traverse through the blade 16 in the direction of arrow 194. The blade 16 rotates in the direction of arrow 196. As the brick 18 approaches the back half of the blade 16, the friction between the blade 16 and the brick 18, lifts the veneer tile 12 upward. To prevent the veneer tile 12 from lifting upward and jamming between the guide 20 and the blade 16, the hold down bar 188 is positioned above the brick 18 and more particularly, above the veneer tile 12. The hold down bar 188 holds the veneer tile 12 in place as the brick 18 passes through the blade 16.

Additionally, a tube 198 is connected to the hold down bar 188. The tube 198 delivers liquid (e.g., water) to a hole 200 in the hold down bar 188. The hole 200 is positioned in the front half of the blade 16, and preferably near the point where the brick 18 initially contacts the blade 16. The liquid flows through the tube 198 in the direction of arrow 202 under pressure. The liquid is introduced on one side of the blade 16 and forces water into the cut formed by the blade 16 in the brick. Water flows in the cut and helps to reduce the frictional forces that might lift the veneer tile 12 as the veneer tile 12 passes through the rear side of the blade 16.

The above description is given by way of example, and not limitation. Given the above disclosure, one skilled in the art could devise variations that are within the scope and spirit of the invention disclosed herein, including various ways of unloading the veneer tiles. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A machine for fabricating brick veneer tiles from bricks, each brick defining a horizontal thickness, the machine comprising:

first and second conveyors for moving the bricks from loading sections through saw blade sections to cut the bricks to unloading sections;

first and second saw blades respectively disposed above the first and second conveyors at the saw blade sections;

first and second guides disposed on an arbor side of the first and second saw blades; and a plurality of first elongate flexible fingers and a plurality of second elongate flexible fingers, the plurality of first and second elongate flexible fingers disposed opposite respective first and second guides with respect to the first and second saw blades, a first distance between distal tips of the first elongate flexible fingers and the first guide being less than the horizontal thickness of the bricks and a second distance between distal tips of the second elongate flexible fingers and the second guide being less than the horizontal thickness of the bricks for pushing the bricks toward the arbor side and against the guides during operation of the machine;

a saw blade motor vertically aligned to the arbor;

a belt attached to the arbor and the blade for transferring motion from the motor to the arbor.

2. The machine of claim 1 wherein each of the plurality of elongate flexible fingers has a pinion gear, and the machine further comprises a rack traverseable in a direction of movement of the conveyor, the rack being engaged to the pinion gears of the elongate flexible fingers for rotating the elongate flexible fingers by traversing the rack forward or rearward and adjusting pressure that the elongate flexible fingers apply to the brick by incrementally traversing the rack forward or rearward.

3. The machine of claim 2 wherein each of the elongate flexible fingers can be lifted out of engagement with the rack and rotationally repositioned to increase or decrease the pressure such elongate flexible finger applies to the brick.

4. The machine of claim 1 further comprising a sensor disposed upstream of the saw blade for sensing a position of a lateral side of the brick, the sensor operative to send a signal to a stepper motor for incrementally traversing the rack forward or rearward to adjust tension of the adjustable push finger for the upcoming brick to be cut by the saw blade.

5. The machine of claim 1 further comprising an auto feeder system having:

a sensor for sensing a position of the conveyor;

an actuator for advancing the brick from the auto feeder system onto the conveyor.

6. The machine of claim 5 wherein the sensor is a mechanical sensor for sensing a cleat of the conveyor.

7. The machine of claim 5 wherein the actuator is a conveyor or solenoid.

8. The machine of claim 1 wherein the guide is rotatable closer to or further away from the saw blade for adjusting a thickness of the veneer tiles.

9. The machine of claim 1 wherein the conveyor moves in a forward direction and the saw blade rotates in a forward direction.

10. The machine of claim 1 further comprising a hold down bar attached to the guide, the hold down bar extending, laterally outward so as to be disposed over the brick when the brick is pushed through the blade, the hold down bar having an opening disposed in a front half of the blade and a tube for delivering, liquid to the opening for directing the liquid to the cutting area between the blade and the brick.

11. The machine of claim 1 wherein each of the elongate flexible fingers has a pinion gear, and the machine further comprises a rack traverseable in a direction of movement of the conveyor, the rack being engaged to the pinion gears of the elongate flexible fingers for rotating the elongate flexible fingers by traversing the rack forward or rearward and adjusting pressure that the elongate flexible fingers apply to the brick by incrementally traversing the rack forward or rearward.

12. The machine of claim 1 wherein an output shaft of the saw blade motor is disposed directly above the arbor.

13. The machine of claim 1 further comprising a conveyor motor, the machine further comprising first and second slip clutches respectively attached to the conveyor motor and the first and second conveyors so that the first and second conveyors continue to run even if the other conveyor is jammed.

14. The machine of claim 1 the first and second conveyors move in a forward direction and the first and second saw blades rotates in a forward direction.

15. The machine of claim 1 wherein the belt is disposed at a midpoint between the first and second saw blades.

* * * * *